US005709279A

United States Patent [19]

Dennis

[11] Patent Number: 5,709,279

[45] Date of Patent: Jan. 20, 1998

[54] DRILL BIT INSERT WITH SINUSOIDAL INTERFACE

[76] Inventor: Mahlon Denton Dennis, 2020 Rankin Rd., Houston, Tex. 77073

[21] Appl. No.: 444,067

[22] Filed: May 18, 1995

[51] Int. Cl.[6] ..... E21B 10/36

[52] U.S. Cl. ..... 175/430; 175/432

[58] Field of Search ..... 175/426, 430–432, 175/374

[56] References Cited

U.S. PATENT DOCUMENTS

| | | | |
|---|---|---|---|
| 5,180,022 | 1/1993 | Brady | 175/431 X |
| 5,303,787 | 4/1994 | Brady | 175/431 X |
| 5,383,526 | 1/1995 | Brady | 175/57 |

*Primary Examiner*—Roger J. Schoeppel
*Attorney, Agent, or Firm*—Gunn & Associates, PC

[57] ABSTRACT

An insert is defined by the present invention. The insert is an elongate cylindrical body having two end faces. At the extended end, the end face supports a PDC layer which is bonded thereto by brazing or sintering and is formed of PDC material to resist impact or shock loading and to provide a long life. The PDC layer is joined to the insert body at a surface which is defined by a central elevated point, the point being relatively small in diameter or is a point, land wherein said straight radial lines extend downwardly and outwardly therefrom. The intercept of the end face with the outer surface of the insert body is an undulating sinusoidal wave form of multiple sinusoidal cycles. This provides a shock resistant insert construction.

23 Claims, 1 Drawing Sheet

FIG. 2
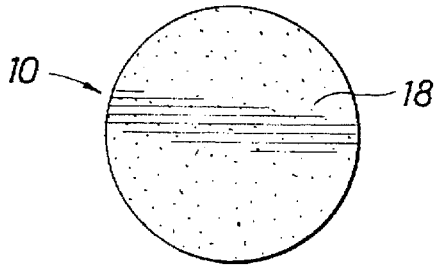
FIG. 1
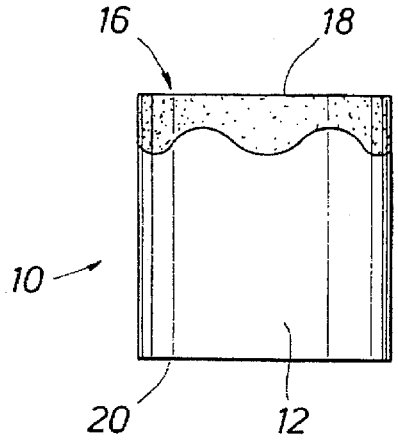
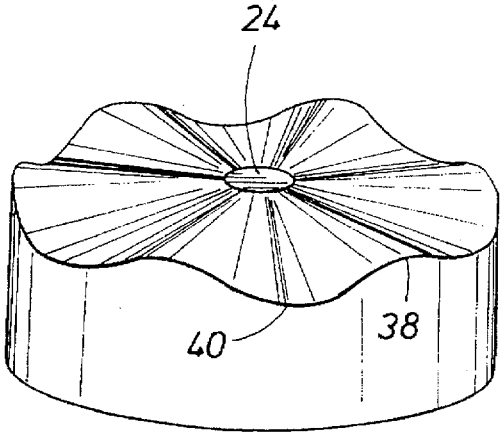
FIG. 5
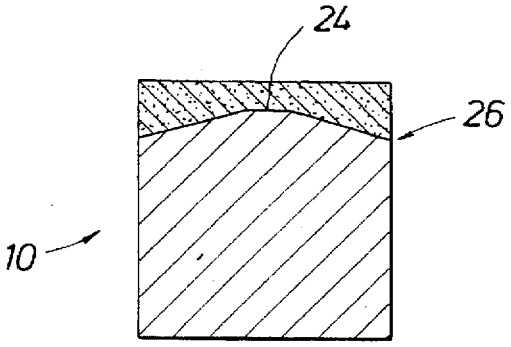
FIG. 3
FIG. 4
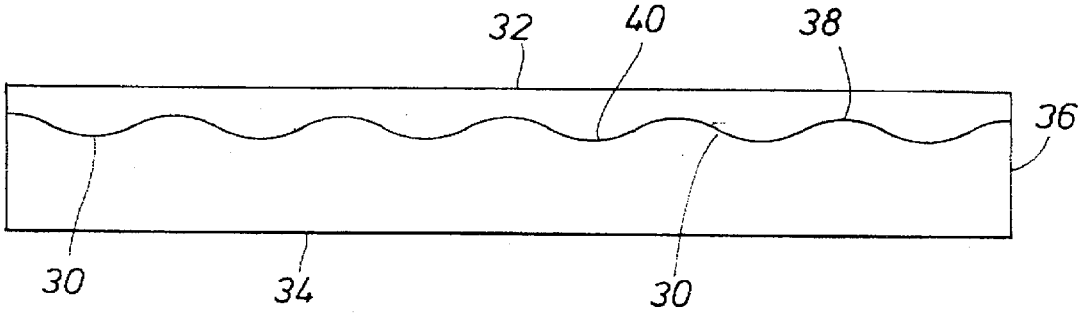

DRILL BIT INSERT WITH SINUSOIDAL INTERFACE

BACKGROUND OF THE DISCLOSURE

The present disclosure is directed to a drill bit insert, and especially one which incorporates an elongate cylindrically formed body of very hard metal covered at an end face. One end of the drill bit insert is constructed for insertion into an opening drilled into a drill bit body. Alternately, it can be mounted in the cone of a multi-cone drill bit. The insert is normally mounted on the cone or drill bit body with an interference fit wherein the hole is slightly smaller than the diameter of the insert. In some instances, the insert is brazed in place. The insert is normally constructed with elongate, right cylindrical construction to thereby enable the drill bit insert to be anchored. This positions one end of the insert in a recessed hole or location while the exposed end of the insert extends toward the formation being drilled to enable drilling. When the insert is positioned in this fashion, the exposed outer end is normally intended to cut against the well borehole while forming the drilled well. This mounting position for the insert is effective to extend the life of the insert to the maximum.

The insert is made of metal which is harder than steel. The exposed end is normally worn by use. In one aspect of the present disclosure, the exposed end is covered with man-made diamond material. This is sometimes known as a polycrystalline diamond compact and is normally referred to as PDC. The PDC material is especially durable. It is hard as diamond and is relatively slick. It will therefore last much longer in drilling situations. In addition to that, it is resistant to shock loading of the sort which is normally encountered in a drilling situation.

Many forms and types of PDC coverings for the end of the insert have been devised heretofore. The present disclosure sets forth an improved form of insert. In particular, it discloses and sets forth an insert which is capable of joinder to the insert body at a joinder surface which is not subject to shearing in the event of lateral impact loading during use.

While drilling, the insert can be subjected to loading which is centerline, and is coincident with the axis. In one aspect, loading can be a shear force which tends to break off the PDC covering on the tip. This might occur in the instance where the PDC crown has a face which is perpendicular to the axis of the insert. Other joinder surfaces have been devised. In particular, the present system sets forth an insert in which the end face of the PDC insert is shaped in a sinusoidal wave form. Moreover, the surface is a sloping surface so that the PDC layer is joined at a surface located in a single transverse plane. Rather, the connective plane is tapered and also extends to something of a point where the point region is raised and truncated. The PDC crown at the truncated point has a specified thickness which increases at the outer peripheral edge.

The PDC layer is shaped for bonding to the cylindrical insert. Indeed, the PDC layer intercepts the outer cylindrical wall at a curving edge or line which is a sinusoidal wave. This wave fully encircles the PDC and the insert. The wave provides a smooth continuous line fully around the PDC insert. The wave is continuous and has the form of at least two full cycles represented by the symbol N where N is a whole number integer and is 2, 3, 4, . . . . While N can be larger, there is no particular gain in making it much more than about 10 or 12. The excursion of the sinusoidal wave is related to the diameter of the insert body. More specifically, the sinusoidal surface is constructed and arranged so that the surface of the insert from the centerline axis thereof to the sinusoidal wave on the periphery is defined by straight-line radial segments without curvature. The central point at the centerline axis of the insert functions somewhat as the focus of the several undulations.

The structure of this device is an insert which operates in a omnidirectional manner when the insert is installed in the cone or head of a drill bit. Without regard to the direction, shearing forces which might otherwise shave off the PDC layer do not act across a common shear plane. Rather, the undulating in the interface between the two components prevent such shearing.

BRIEF SUMMARY OF THE PRESENT DISCLOSURE

This disclosure sets forth an insert which is typically an elongate cylindrical body formed of a hard material such as steel or and even harder metal such as tungsten carbide in a supportive matrix. At one end, there is an end located surface which has the form of a central circular plateau on the face. There is a surrounding surface which extends to the outer periphery of the elongate cylindrical body and which intercepts the periphery in the form of a sinusoidal wave form. The wave form extends fully around the periphery in 2, 3 or 4 cycles of the sinusoidal wave form. This end face is used as an anchor surface for a PDC layer attached to it by brazing or sintering. When assembled, the PDC layer is difficult to dislodge, in large part because there is no single shear surface at which component failure might occur.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is of the drawings is a side view showing the completed insert of the present disclosure which has an exposed end covered with a PDC layer;

FIG. 2 of the drawings is an end view of the insert shown in FIG. 1 of the drawings;

FIG. 3 of the drawings is a view of the insert of FIG. 1 which has been sectioned to show an internal interface;

FIG. 4 of the drawings is a complete circumferential drawing of the outer cylindrical wall of the insert showing the underlying interface which is in the form of a sinusoidal wave form; and FIG. 5 is an isometric view of the lower portion of the insert with the PDC layer omitted to thereby show the underlying surface for attachment to the PDC surface.

DETAILED DESCRIPTION OF THE PREFERRED EMBODIMENT

Attention is now directed to FIG. 1 of the drawings where the number identifies the insert of the present disclosure. In FIG. 1, this component has the preferred shape of a right cylindrical metal member which has a lower portion 2 formed either of steel or some harder metal. One harder material is obtained by forming an elongate cylindrical member of tungsten carbide particles which are supported in a matrix of metal to hold the right cylinder body together. This will be described hereinafter as the insert body. It is provided with a transverse bottom face, and has a top face with a special shape as will be detailed. This insert body 12 is joined to a PDC layer 6 which is affixed to the upper end. The PDC layer has a diameter equal to that of the insert body. It terminates at a smooth upper face 8 which is parallel to the lower face 20. In the preferred construction, the face 18 is circular as shown in FIG. 2 of the drawings. The face may also match the substrate pattern as shown in FIG. 4, discussed below.

The PDC layer is joined to the insert body 12 by brazing or sintering. A braze metal is placed between the two and is heated to a requisite temperature which assures melting. It melts and forms an adhesive interface holding the two components together. Moreover, the joined components have an interface which is a significant aspect of the present disclosure and which will be detailed in substantial fashion hereinafter. Going momentarily to FIG. 3 of the drawings, this shows that the interface has a central circular portion 4. This circular portion is aligned with the centerline axis of the insert body. The circular portion 24 is a full circle which is preferably of reduced diameter ranging from about 20% of the diameter of the insert and smaller. Where it is less, the circle 24 is reduced in relative diameter, and it can even be reduced to the extent that the circle 24 is a simple point. The preferred construction however utilizes a small circular portion 24 which is in the range of about 10–25% of the diameter of the insert body 12.

Going back now to FIG. 1 of the drawings, it will again be noted that view is taken in conjunction with FIG. 3 of the drawings to illustrate that the circle 24 is raised or elevated with respect to the remainder of the interface. The entire interface is therefore represented generally by the numeral 26. There are two aspects of this which are especially noteworthy. The interface 26 has the central circle, but it also has an underlying portion which extends radially outwardly. This PDC layer edge defines the interface which is visible on the outer cylindrical surface of the insert body. This is shown better in FIG. 4 of the drawings.

FIG. 4 of the drawings is an expanded and full illustration of the edge of the interface 26 where it comes to the surface on the exterior of the cylindrical body. More specifically, this is shown in FIG. 4 of the drawings where the projection of the curvature on the outer cylindrical surface is identified by the numeral 30. This underlying wave form 30 has an excursion which is described below. It undulates from peak to valley so that it forms a specified number of cycles of the sinusoidal wave form. The number of cycles is usually a whole number integer which is either 2, 3, or 4. It is preferable to have at least one whole cycle, and so the preferred number N of cycles is 2, 3 or 4. FIG. 4 thus shows the top face 18 at the peripheral line 32. It likewise shows the bottom face 34 at the bottom circumferential line 34. It also shows the circular outer wall at an arbitrarily defined end indicated at 36.

Going now to FIG. 5 of the drawings, the center face 24 is likewise illustrated in the isometric representation of the tungsten carbide insert body. The underlying surface is shown deployed there around wherein a set of radial lines enhance the illustration of FIG. 5 by presenting the rise and fall of this surrounding surface. The rise and fall of this surface forms a continually curving surface which is exposed to any shear forces impacting the insert. Moreover, the shear forces may find a single plane at which shearing could be possible but shearing normally does not occur because the interface is located in a number of shear planes. To consider this further, the underlying surface which fully encircles the central circle 24 is located below the circle 24. To be sure, at the peak of the curvature indicated at the point 38 in FIG. 4, the radial line still extends downwardly from the circular center portion at a reduced angle. The peak 38 which is shown in FIG. 5 is ideally located at a depressed angle with respect to the center portion 24. That angle can be anywhere from about 1 to about 30°. In addition to that, the valley 40 is located at a greater reduced angle. Depending on dimensions, this angle can be as much as about 30° or so. Quite obviously, the radial line to the valley 40 shown in FIG. 5 has a downward inclination which is sufficiently greater than the radial line to the peak 8 so that the two radial lines inscribe the angle of the undulations which are shown in the full circle development of FIG. 4.

The insert body is constructed as mentioned above with the undulating top face. If desired, the radial lines may come to a point coincident with the centerline axis of the body. It is however more desirable that the circular end face 24 have a finite width.

The PDC layer is fabricated to mate against the tungsten carbide insert body. The two are joined together integrally at selected pressures and temperatures, or are attached by a layer of braze material between them. The surfaces are conforming or mating. It is desirable that the conformance be substantially perfect so that a very thin brazed layer between the two is sufficient. The quantity of braze material required is preferably kept to a minimum so that surplus braze material is not extruded around the undulating interface on the outer wall.

In use, the PDC equipped tungsten carbide bit insert illustrated by this disclosure is very effective in resisting shear forces applied from any direction. If the impact is felt on any point on the side, the possibility of shearing the PDC layer is reduced so that fracture of the crystalline material in the PDC layer is reduced.

While the foregoing is directed to the preferred embodiment, the scope of the present disclosure is determined by the claims which follow.

I claim:

1. An insert for use in drilling or other wear applications comprising:

(a) an elongate body having a central axis there along extending from a first end to a second end wherein the first end connects with a drill bit and the second end extends from the drill bit to enable the insert to conduct drilling operations while drilling a well borehole;

(b) a covering of material having hardness greater than the metal forming said insert body wherein the material covers the second end of said insert body; and (c) wherein said insert body second end is formed with a surface having multiple cycles of sinusoidal undulations where said surface intersects the outer surface of said insert body, and said surface slopes downwardly from a central portion of said surface coincident with the axis through said body.

2. The apparatus of claim 1 wherein said sinusoidal undulations have an excursion of a specified range and the number of cycles is up to 12.

3. The apparatus of claim 2 wherein said undulations define radial lines extending toward the outer surface of said insert body and said radial lines are straight line segments.

4. The apparatus of claim 3 wherein said straight-line segments extend to said sinusoidal undulations and the straight-line segments extend downwardly at an angle in excess of about 1°.

5. The apparatus of claim 4 wherein said straight-line segments extend downwardly at angles between about 1° to about 30°.

6. The apparatus of claim 5 wherein said surface has a centered planar face.

7. The apparatus of claim 1 wherein said surface is defined by straight, sloping radial lines to said insert body outer face.

8. The apparatus of claim 7 wherein said surface is defined by straight, sloping radial lines sloping between about 1° to about 30°.

9. An insert for use in a drill bit, machinery or wear applications, comprising:

(a) an elongate right cylinder body formed of tungsten carbide in a supportive matrix and having an exposed outer end;

(b) a PDC layer affixed to the exposed outer end of said insert body wherein said PDC layer defines an exposed circular face for drilling wherein the exposed circular face is constructed and arranged with respect to said insert body so that contact during drilling occurs primarily on said PDC layer; and (c) an undulating sinusoidal curve of at least two sinusoidal cycles is defined at said surface between said PDC layer and said insert body and said PDC layer is sufficiently thick that said PDC layer is exposed to shock loading during use and said undulating surface is defined by straight line segments extending radially from the central axis of said insert body to the outer cylindrical face of said insert body, and said straight-line segments slope downwardly from the central axis thereof.

10. The apparatus of claim 9 wherein said undulating curve has N cycles and N is less than 12.

11. The apparatus of claim 10 wherein said curve is sinusoidal and on the surface and forms an surface at all areas of the surface.

12. An insert for use in drilling or other wear applications comprising:

(a) an elongate body having a central axis there along extending from a first end to a second end wherein the first end connects with a drill bit and the second end extends from the drill bit to enable the insert to conduct drilling operations while drilling a well borehole;

(b) a covering of material having hardness greater than the metal forming said insert body wherein the material covers the second end of said insert body; and (c) wherein said insert body has a surface with multiple cycles of sinusoidal undulations and said undulations extend from a central portion of said surface coincident with the axis through said body.

13. The apparatus of claim 12 wherein said undulations comprise multiple cycles of sinusoidal undulations.

14. The apparatus of claim 13 wherein said sinusoidal undulations have an excursion of a specified range and the number of cycles is up to 12.

15. The apparatus of claim 14 wherein said undulations define radial lines extending toward the outer surface of said insert body and said radial lines are straight line segments.

16. The apparatus of claim 13 wherein said surface is defined by straight, sloping radial lines to said insert body outer surface.

17. The apparatus of claim 16 wherein said surface is defined by straight, sloping radial lines sloping between about 1° to about 30°.

18. An insert for use in drilling or other wear applications comprising:

(a) an elongate cylindrical body having a central axis there along extending from a first end to a second end wherein the first end connects with a drill bit and the second end extends from the drill bit to enable the insert to conduct drilling operations while drilling a well borehole;

(b) a covering of material having hardness greater than the metal forming said insert body wherein the material covers the second end of said insert body; and (c) wherein said cylindrical body second end is formed with a surface having multiple sinusoidal undulations.

19. The insert of claim 18 wherein said undulations slope from a central portion of said end coincident with the axis through said body.

20. The apparatus of claim 18 wherein said undulations comprise multiple cycles of sinusoidal undulations.

21. The apparatus of claim 20 wherein said sinusoidal undulations have an excursion of a specified range and the number of cycles is up to 12.

22. The apparatus of claim 20 wherein said surface is defined by straight, sloping radial lines to said insert body outer face.

23. The apparatus of claim 22 wherein said surface is defined by straight, sloping radial lines sloping between about 1° to about 30°.

* * * * *